United States Patent [19]

Mullay

[11] 4,104,092

[45] Aug. 1, 1978

[54] EMULSION SENSITIZED GELLED EXPLOSIVE COMPOSITION

[75] Inventor: John J. Mullay, Hazelton, Pa.

[73] Assignee: Atlas Powder Company, Tamaqua, Pa.

[21] Appl. No.: 816,858

[22] Filed: Jul. 18, 1977

[51] Int. Cl.[2] ..... C06B 45/00

[52] U.S. Cl. ..... 149/2; 149/41; 149/42; 149/43; 149/44; 149/46; 149/60; 149/61; 149/76; 149/83; 149/85

[58] Field of Search ..... 149/2, 40, 41, 46, 42, 149/43, 60, 44, 61

[56] References Cited

U.S. PATENT DOCUMENTS

| | | | |
|---|---|---|---|
| 3,456,589 | 7/1969 | Thomison et al. | 149/46 X |
| 3,653,992 | 4/1972 | Fee et al. | 149/46 X |
| 4,008,110 | 2/1977 | Machacek | 149/46 |

*Primary Examiner*—Stephen J. Lechert, Jr.

*Attorney, Agent, or Firm*—Richards, Harris & Medlock

[57] ABSTRACT

Gelled explosive compositions, sensitized with water-in-oil explosive emulsions, are provided which do not require high explosive sensitizing agents and which contain oxidizing salts, water, gelling agents, and, optionally, bulking agents and fuels, as well as from about 1 to about 80 percent by weight of a water-in-oil explosive emulsion sensitizer which can be of the cap sensitive or cap insensitive variety.

25 Claims, No Drawings

EMULSION SENSITIZED GELLED EXPLOSIVE COMPOSITION

BACKGROUND OF THE INVENTION

In one aspect the present invention relates to aqueous gelled explosive compositions containing water-in-oil emulsion explosive compositions as sensitizers. In another aspect, this invention relates to the use of water-in-oil explosive emulsions as a substitute for sensitizing agents such as high explosives and metallic fuels in aqueous gelled explosive compositions. In still another aspect this invention relates to a process for preparing a sensitive aqueous gel explosive composition employing water-in-oil explosive emulsions as sensitizing agents.

Aqueous slurry blasting agents have become increasingly more important in the blasting industry due to their ease of preparation, water resistance and ease of handling. The addition of a gelling agent to form aqueous gel explosive compositions has become increasingly popular within the explosives industry because of the water resistance and tamping properties of such compositions. Generally, gelled explosive compositions are composed of oxidizers, water, fuels, sensitizing agents and bulking and gelling agents. By controlling the amount of gelling agent present in the composition, gelled explosives can take the form of a flowable fluid or a relatively stiff gelled composition which can be packaged in a variety of containers. It has been recognized in the past that gelled explosive compositions must contain a sensitizing agent in order to have acceptable strength and detonation properties. In the past high explosives or particulized metallic agents have been employed in order to sensitize the oxidizer-water mixture. However, use of pre-manufactured high explosives, such as TNT for example, presents a safety hazard in the handling, manufacture and transportation of the explosive gel compositions. Further, sensitizing agents which have been employed in the past are relatively expensive.

A separate and distinct type of explosive compositions are water-in-oil emulsion type blasting agents. Basically, these blasting agents contain an aqueous solution of inorganic oxidizer salt which is emulsified as the dispersed phase within a continuous carbonaceous fuel phase. Water-in-oil emulsions also contain a uniformly distributed gaseous component as a sensitizer. Water-in-oil emulsion type blasting agents were first disclosed by Bluhm in U.S. Pat. No. 3,447,978. As is the case with gelled explosive compositions, water-in-oil emulsion explosives have been widely accepted by the explosive industries because of their water resistance and superior handling qualities. However, there is a marked distinction between water-in-oil type emulsion blasting agents and the aqueous gelled explosive compositions described above. Gelled explosive compositions basically comprise an aqueous solution of oxidizers, fuels and sensitizing agents which has been gelled with one of a variety of aqueous gelling agents such as guar gum and a suitable crosslinker for example. In contrast, water-in-oil emulsion explosives are comprised of two distinct phases, the carbonaceous oil being the continuous phase and the aqueous solution of oxidizing agents being the discontinuous phase of the emulsion with a dispersed gaseous component distributed throughout the emulsion.

Because of the rapid and wide acceptance of gelled explosive compositions the development of relatively sensitive gelled explosive compositions which do not employ relatively expensive or hazardous materials, such as pre-manufactured high explosives, is desirable. In the past various attempts have been made to eliminate the need for pre-manufactured high explosive sensitizing agents. For example, U.S. Pat. No. 3,431,155 discloses the use of methyl amine nitrate as a sensitizer for aqueous gel explosives. However, this is a relatively expensive ingredient and does not completely resolve the safety problems present when high explosive sensitizers are used. Another sensitizing agent for aqueous gel explosive compositions is disclosed in U.S. Pat. No. 3,923,565. That patent discloses that sodium dodecyldiphenyl ether disulphonate may be used as a sensitizing agent in aqueous gel explosives. However, it appears that the final explosive compositions of that reference must have a density lower than about 1.15 grams per cubic centimeter in order to obtain maximum useful detonation characteristics. Therefore, there if a continuing need in the explosive industry for an aqueous gel explosive composition which can be sensitized without the use of relatively expensive or dangerous sensitizing agents and which can be formulated so as to have a range of useful densities.

SUMMARY OF THE INVENTION

The aqueous gel explosive of the subject invention overcomes the deficiencies of the prior art in that relatively safe low cost sensitizing agents, in the form of water-in-oil explosive emulsions, are employed. While these emulsions themselves can be termed "high explosives" in some cases, they are not as expensive or shock sensitive as TNT, for example. Further they may be prepared at the same location at which they are incorporated into the aqueous gel explosive thus reducing handling problems. It has been discovered that water-in-oil type emulsion explosives can be admixed with an aqueous gel explosive to form an emulsion sensitized aqueous gel explosive composition which has excellent detonation properties over a range of useful densities. The emulsion sensitized gel explosive compositions of the present invention can include from about 1 to about 80% by weight of the water-in-oil explosive emulsion sensitizing composition. Additionally, from about 0 to about 90 weight percent oxidizing salts, from about 5 to about 25% water, from about 0.2 to about 2% by weight aqueous gelling agents, and bulking agents in an amount of from about 0.2% to about 10% by weight of the composition, are included in the explosive gel composition. Further, additional sensitizers in an amount up to about 20% by weight, and fuels in an amount up to about 15% by weight can be included as desired. The water-in-oil explosive emulsions employed as sensitizing agents for the gelled explosive compositions of the subject invention generally comprise an aqueous solution of oxidizing salts dispersed, with the aid of an emulsifier, within carbonaceous fuels. Optionally, bulking agents and additional fuels can also be present within the explosive emulsion sensitizing agent.

DETAILED DESCRIPTION OF THE INVENTION

Thus, I have discovered that aqueous gel explosive compositions can be sensitized by employing explosive emulsion compositions in place of a pre-manufactured high explosive or other hazardous or expensive sensitizing agents. The use of explosive emulsions as sensitizers provides a wide range of formulation possibilities allowing characteristics of the gelled explosive, such as density and oxygen balance, for example, to be adjusted as desired. Further, the use of explosive emulsions as sensitizers for gelled explosives has been discovered to provide for gelled explosives of greater power in that a larger amount of inorganic oxidizers may be incorporated into the composition than can be employed in conventionally sensitized gelled explosives.

As used herein the term "gel portion" refers to the aqueous gel explosive composition alone, in the absence of any explosive emulsion sensitizer. The term "explosive emulsion sensitizer" refers to the emulsion sensitizer which is added to the gel portion for the purpose of improving the detonation properties of the gel portion. Of course, the explosive emulsion sensitizer comprises two distinct phases, that is, a discontinuous aqueous phase dispersed within a continuous oil phase.

For clarity the gel portion of the emulsion sensitized gel explosive compositions of the present invention will be discussed first, followed by a description of the explosive emulsion sensitizers which have been found to be useful. Finally, a description of how the explosive emulsion sensitizer can be employed to sensitize the gel portion in order to form the emulsion sensitized explosive gel composition of the invention will be set forth.

Inorganic oxidizing agents useful in the gel portion of the present invention include nitric acid as well as inorganic nitrates and perchlorates. Generally the inorganic salts are selected from the nitrate or perchlorate salts of ammonia, alkali, or alkaline earth elements as well as Group III elements. Preferred inorganic oxidizing salts include ammonium nitrate, sodium nitrate, and sodium perchlorate.

The fuels included in the gel portion of the subject invention can include either solid or liquid fuels. Solid fuels can be of the carbonaceous type such as soft coal or graphite. Other solid fuels such as particulate aluminum, sulphur or ferrophosphorous can also be employed. In addition liquid fuels such as water soluble organic materials for example alcohols, amides or sugars can be used. Ethylene glycol is a preferred fuel material. Water soluble liquid fuels such as diesel fuel oil, benzene and xylene, for example, can also be employed. Generally fuels will comprise up to about 15 weight percent of the emulsion sensitized explosive gel composition.

Suitable bulking agents known in the art are also included in the gel portion in an amount of from about 0.2 to about 10 weight percent of the emulsion sensitized explosive gel composition. These bulking agents can include, for example, glass or resin microballoons, perlite, as well as occluded air or other gases.

In addition to the explosive emulsion sensitizers employed in the explosive gel of the subject invention auxillary sensitizers previously known in the art can also be employed in the gel portion. For example, commercial grade nitromethane, or ethylene diamine dinitrate can be used as additional sensitizers. Other sensitizers such as nitroalkanes, amine nitrates and heavy metal compounds, such as copper chloride for example, can also be employed generally in an amount up to about 20 weight percent of the emulsion sensitized explosive gel composition.

Gelling agents for the aqueous medium containing the above described components can be any of those known to the prior art. Guar gum is the preferred thickener. However, other thickening agents such as polyacrylamide, carboxy methyl or ethyl cellulose, biopolymers such as xanthan gum or derivatives of guar gum such as hydroxyethyl or hydroxypropyl guar can be employed. Further, a suitable crosslinker for the thickening agent such as, for example, potassium pyroantimonate, boric acid, ferric chloride or other heavy metal compounds can also be added as desired. Generally, the aqueous gelling agent will be present in an amount of from about 0.2 to about 2.0 weight percent based on the weight of the emulsion sensitized explosive gel composition.

The above described materials can be admixed with water as previously described to form a gel explosive composition substantially similar to those previously known in the art. However, it has been discovered that in place of relatively expensive and dangerous high explosive materials an explosive emulsion composition can be admixed with the explosive gel composition in an amount of from about 1 to about 80% by weight of the final composition to obtain a sensitive explosive gel composition having excellent detonation and storage characteristics. The explosive emulsions utilized as sensitizers in the subject invention may be cap sensitive or non-cap sensitive. In either case it has been discovered that the use of explosive emulsions as a sensitizer in gelled explosive compositions results in a sensitive composition which can be used in either packaged form or in a flowable condition without a package and can be detonated in relatively small diameters, for example about 2 inches or greater.

In general, the explosive emulsion sensitizer of the subject invention comprises from about 40 to about 90% by weight of inorganic oxidizing salts; from about 4 to about 20% water; from about 0.2 to about 5.0% by weight emulsifiers; from about 2 to about 50% by weight carbonaceous fuels; and, optionally, up to about 40% by weight sensitizing agents, up to about 15% by weight bulking agents, and up to about 20% of additional fuels.

The inorganic oxidizer salt of the emulsion sensitizing agents of the subject invention are preferably selected from alkali or alkaline earth metal nitrates including, for example, sodium nitrate and ammonium nitrate. Preferably inorganic nitrates such as sodium nitrate and ammonium nitrate comprise from about 40 to about 90% by weight of the explosive emulsion sensitizer. Up to about 20% inorganic perchlorates can also be employed, for example, sodium perchlorate.

The carbonaceous fuel component of the explosive emulsion sensitizer of the subject invention can include most hydrocarbons, for example, paraffinic, olefinic, naphthenic, aromatic, saturated or unsaturated hydrocarbons. In general, the carbonaceous fuel is a water immiscible emulsifiable fuel which is either liquid or liquifiable at a temperature up to and about 200° F and preferably between 110° F and about 160° F. It is preferable, from a sensitivity standpoint, that the carbonaceous fuel include a combination of a wax and an oil. Waxes having melting points of at least 80° F, and preferably in the range of about 110° to about 200° F, are usually suitable. Examples of suitable waxes include waxes derived from petroleum, such as petrolatum wax, microcrystalline wax, and paraffin wax, mineral waxes such as ozocerite and montan wax, animal waxes such as spermacetic wax, and insect waxes such as beeswax and Chinese wax. Examples of suitable oils include the various petroleum oils, various vegetable oils and the like. Diesel oil is a preferred example of a petroleum oil useful within the scope of this invention. These carbonaceous fuels can be employed in amounts of from about 2 to about 50% by weight of the explosive emulsion sensitizer and preferably in amounts of from about 2 to about 10% by weight thereof.

Suitable emulsifying agents which can be used in the scope of this invention to form the explosive emulsion sensitizer are water-in-oil emulsifiers such as those derivable from sorbitol by esterfication with removal of one molecule of water such as sorbitan, fatty acid esters, for example, sorbitan monolaurate sorbitan monooleate, sorbitan monopalmitate, sorbitan monostearate, and sorbitan tristearate. Other useful emulsifying agents comprise mono- and diglycerides of fat forming fatty acids, as well as polyoxyethylene sorbitol esters, such as polyoxyethylene sorbitol beeswax derivative materials and polyoxyethylene (4) lauryl ether, polyoxyethylene (2) oleyl ether, polyoxyethylene (2) stearyl ether, oleate, polyoxyalkylene, laurate, oleyl acid phosphate, substituted oxazolines, and phosphate esters and mixtures thereof and the like. In addition, ammonium and alkali metal stearate salts, for example sodium stearate, can be employed, either alone or in combination with stearic acid. Generally such emulsifying agents should be present in an amount equal to about 0.2 to 5.0 weight percent of the explosive emulsion sensitizer.

Bulking agents can comprise up to 15% by weight of the explosive emulsion sensitizer. Generally the same types of bulking agents as described above with respect to the gel portion of the explosive composition of the subject invention can be employed. Preferably glass or resin microballoons are employed as bulking agents.

Sensitizing agents in amounts of up to about 40% by weight of the emulsion sensitizer can be employed. Suitable sensitizing agents include the alkylamine and alkanolamine nitrates and perchlorates, including, for example, methylamine nitrate.

Additionally, auxillary fuels can be added to the emulsion sensitizer of the subject invention in an amount up to about 20% by weight thereof. In general auxiliary fuels such as aluminum, aluminum alloys, magnesium and the like can be employed. Particulate aluminum is the preferred such auxiliary fuel.

The emulsion sensitizers can be prepared in any conventional manner, such as the methods described in U.S. Pat. No. 3,447,978 to Bluhm. For example, the explosive emulsion sensitizer component of the subject invention can be prepared by premixing the water (which is present in an amount of from about 4 to about 20% by weight of the emulsion sensitizer) and the inorganic oxidizer salts in a first premix, and the carbonaceous fuel and emulsifier in a second premix. If necessary, the premixes may be heated in order to aid in the dissolving of the inorganic salts in the aqueous solution and to attain proper consistency in the carbonaceous fuel premix. Generally the first premix is heated until the salts are completely dissolved, which generally occurs at temperatures between about 120° to about 205° F. The second premix is heated, if necessary, until the carbonaceous fuel has liquified (generally at about 120° F or more if wax materials are utilized). The premixes can then be blended together and emulsified and thereafter the bulking agents, such as glass microballoons, can be incorporated therein. In the continuous manufacture of an emulsion sensitizer useful in the present invention it is preferred to prepare an aqueous solution containing oxidizers in one tank and prepare a mix of the organic fuel components in another tank and thereafter pump the two liquid mixes separately to a mixing device wherein the emulsifier is added to produce the emulsion sensitizer. If bulking agents and auxiliary fuel are to be employed they may be conveniently blended into the emulsion so formed.

The emulsion sensitizer formed in the manner set forth above can then be employed to produce the novel gel explosive composition of the subject invention which in effect comprises a gelled explosive composition sensitized with the explosive emulsion sensitizer. In general, the oxidizing salts to be used in the gel portion are dissolved in the water of the gelled explosive component using appropriate amounts of heat and agitation. Fuels, additional sensitizers (other than the explosive emulsion sensitizer) and bulking agents may then be added to the aqueous solution of oxidizing salts with mixing. The gelling agents and, if desired, the crosslinkers therefor, may then be admixed and the resulting composition allowed to thicken. Finally, the emulsion sensitizer is added to the gelled explosive composition with sufficient agitation to cause its dispersion within the explosive gel composition. Optionally, the emulsion sensitizer can be added to the aqueous solution, with agitation to homogeneously disperse the emulsion sensitizer within the solution, and then aqueous gelling agents may be added to form the emulsion sensitized aqueous gel explosive composition. Various other orders of addition and methods for dispersing the explosive emulsion sensitizer within the gelled explosive composition may also be employed.

The emulsion sensitized aqueous gel explosive compositions of the subject invention have been found to have excellent storage and detonation characteristics. Of course, in order to retain proper detonation characteristics over long periods of time it is preferred that the continuous oil and/or wax phase of the emulsion sensitizer be sufficiently immiscible with and impervious to the aqueous phase of the explosive gel so as to resist attack and breakdown of the explosive emulsion sensitizing agent.

Another advantage of the emulsion sensitized aqueous gel explosive compositions of the present invention is that a larger amount of inorganic nitrates can be incorporated into the total composition without the occurrence of undesirable crystal growth. Apparently, this advantage is a result of the fact that the aqueous solution of oxidizing salts in the emulsion sensitizers are protected from contact with the oxidizing salts present in the gel portion itself by the external oil phase of the emulsion sensitizer. Thus, higher total oxidizing salt content may be achieved within the composition than would be possible in the case where all the oxidizing salts are present in a single aqueous solution.

Furthermore, because the emulsion sensitizer can be formulated so as to have a positive oxygen balance a wide range of formulation possibilities (from an oxygen balance standpoint) are possible. Most conventional sensitizing agents have a negative oxygen balance (that is, they act as a fuel). For example, nitromethane, TNT, DNT, PETN, amine nitrates, and paint grade aluminum are all conventional type sensitizers which have a negative oxygen balance number and therefore when incorporated into explosive compositions may require the addition of non-sensitizing oxidizing agents in order to achieve the preferred oxygen balance. Since the emulsion sensitizers of the present invention can be formulated so as to have either a negative or positive oxygen balance, it is possible to add either more fuels or more oxidizers to the gel portion of the emulsion sensitized aqueous gel explosive composition.

Another significant advantage of the emulsion sensitized gel explosive composition of the present invention is that it has been discovered that a non-primer sensitive aqueous gel explosive composition can be admixed with a non-primer sensitive explosive emulsion composition to form a primer sensitive emulsion sensitized explosive gel composition. Thus, it is possible, for example, to ship the non-primer sensitive gel portion to the site of use, separately from the non-primer sensitive emulsion sensitizer, and combine the gel portion with the emulsion sensitizer at the point of use to form a primer sensitive explosive composition.

The amount of the explosive emulsion sensitizer employed will be influenced by the economic considerations and end use of the explosive gel composition. For example, if a relatively sensitive (for example No. 6 cap sensitive) emulsion sensitizer is employed a relatively small quantity will be sufficient to sensitize the aqueous gel explosive composition. This provides for greater cost savings as well as more formulation possibilities with regards to employing other sensitizing agents in the explosive gel composition. Alternatively, use of a relatively large amount of emulsion sensitizer in the gelled explosive composition allows the entire composition to contain greater amounts of inorganic oxidizers thereby increasing the power output of the explosive composition.

The following examples are given to better facilitate the understanding of the subject invention but are not intended to limit the scope thereof.

EXAMPLE 1

The compositions set forth in Table I below were prepared by dissolving the oxidizing salts in water and mixing at a temperature of about 150° F. The fuels, auxillary sensitizers and bulking agents were then added with further mixing. The gelling agents were then added and stirred and the composition was allowed to thicken. Finally, the explosive emulsion sensitizer, having the composition set forth in Table II below was added with sufficient agitation to cause complete dispersion of the emulsion within the aqueous gel composition.

Table I

| Ingredient | Compositions of Mixes (Expressed in Weight Percent) 1 | 2 | 3 | 4 | 5 | 6 | 7 | 8 | 9 | 10 |
|---|---|---|---|---|---|---|---|---|---|---|
| Ammonium Nitrate | 43.5 | 43.5 | 43.5 | 43.5 | 46.1 | 46.1 | 50.0 | 45.0 | 42.7 | 43.5 |
| Sodium Nitrate | 8.9 | 4.5 | 4.5 | 4.5 | 4.5 | 9.5 | 10.6 | 4.5 | 4.5 | 4.5 |
| Sodium Perchlorate | — | 4.5 | 4.5 | 4.5 | 4.5 | 4.5 | 4.5 | 4.5 | 4.5 | 4.5 |
| Water | 18.8 | 18.8 | 18.8 | 18.8 | 19.0 | 19.0 | 19.0 | 19.0 | 19.0 | 19.0 |
| Ethylene Glycol | 8.9 | 8.9 | 6.7 | 8.9 | 8.9 | 8.9 | 8.9 | 4.5 | 8.9 | 8.0 |
| B28/750 (Glass Microballoons) | 1.3 | 1.3 | 1.3 | 1.3 | 1.3 | 1.3 | 1.3 | 1.5 | — | 1.3 |
| Perlite | — | — | — | — | — | — | — | — | 1.2 | — |
| Emulsion I | 17.9 | 17.9 | 17.9 | 13.4 | 15.0 | 10.0 | 5.0 | 18.0 | 18.5 | 15.0 |
| Nitromethane | — | — | — | 4.5 | — | — | — | — | — | — |
| Ethylene Diaminedinitrate | — | — | — | — | — | — | — | — | — | 3.5 |
| Alcoa 1620 Aluminum | — | — | 2.2 | — | — | — | — | — | — | — |
| Soft Coal | — | — | — | — | — | — | — | 2.3 | — | — |
| Guar | .54 | .54 | .54 | .54 | .60 | .60 | .65 | .65 | .65 | .65 |
| Potassium Pyroantimonate | .0063 | .0063 | .0063 | .0063 | .007 | .007 | .0075 | .0075 | .0075 | .0075 |
| Percol 155 | .089 | .089 | .089 | .089 | 0.1 | 0.1 | 0.1 | 0.1 | 0.1 | 0.1 |
| Final Density of Mix (g/cc) | 1.21 | 1.15 | 1.17 | 1.16 | 1.19 | 1.20 | 1.30 | 1.15 | 1.19 | 1.22 |

TABLE II

| Ingredient | Weight Percent |
|---|---|
| Wax | 3.0 |
| Oil | 1.0 |
| Emulsifier | 1.0 |
| Water | 12.0 |
| Ammonium Nitrate | 67.6 |

TABLE II-continued

| Ingredient | Weight Percent |
|---|---|
| Sodium Nitrate | 3.0 |
| Sodium Perchlorate | 10.4 |
| Glass Microballoons | 2.0 |

The emulsion sensitizer set forth in Table II was prepared by forming a premix of water and the inorganic oxidizers at about 210° F and the second premix of the carbonaceous fuel and emulsifier at 160° F. The first premix was then slowly added to the second premix with agitation to obtain a water-in-oil emulsion. Thereafter, the glass microballoons were blended into the emulsion to form the explosive emulsion sensitizer employed in the compositions set forth in Table I. The explosive emulsion sensitizer alone was found to be detonable with a No. 6 cap in a ½ inch diameter cardboard cartridge.

Composition number 1 as set forth in Table I was allowed to stand for seven months before testing it for its detonation capabilities. After the seven month storage period it was found to be detonable in a 3 inches diameter plastic cartridge with a 3 × 8 inches Power Primer (supplied by Atlas Powder Company) and a No. 6 blasting cap. Compositions 2–10, as set forth in Table I above, were tested within 2 weeks of manufacture. In all cases a 2½ × 12 inches plastic cartridge was successfully detonated with a 2½ × 8 inches Power Primer and a No. 6 blasting cap. In addition composition 2 was retested after approximately two weeks of storage at 70° F and was found to detonate with three, 10 g Detaprimes, a PETN containing mini-primer manufactured by E. I. DuPont de Nemours & Co., Wilmington, Delaware, and a No. 6 blasting cap.

EXAMPLE 2

In order to investigate whether or not the emulsion sensitizer was responsible for the detonation properties of the gelled explosive compositions set forth in Table I above, compositions 2, 6 and 7 were reproduced with the explosive emulsion sensitizer component omitted. These compositions are set forth below in Table III and are designated *2a, 6a,* and *7a.* The procedures used to prepare these compositions was exactly as set forth above with the exception that no explosive emulsion sensitizer was admixed with the aqueous gel explosive compositions.

TABLE III

| Compositions of Mixes (Expressed in Parts by Weight) Used To Demonstrate The Sensitizing Action of Emulsions | | | |
|---|---|---|---|
| Ingredient | 2a | 6a | 7a |
| Ammonium Nitrate | 43.5 | 46.1 | 50.0 |
| Sodium Nitrate | 4.5 | 9.5 | 10.6 |
| Sodium Perchlorate | 4.5 | 4.5 | 4.5 |
| Water | 18.8 | 19.0 | 19.0 |
| Ethylene Glycol | 8.9 | 8.9 | 8.9 |
| B28/750 | 1.3 | 1.3 | 1.3 |
| Guar | 0.54 | 0.60 | 0.11 |
| Potassium Pyroantimonate | 0.012 | 0.007 | 0.0075 |
| Percol 155 | 0.092 | 0.090 | 0.095 |
| Final Density of Mix (g/cc) | 1.27 | 1.27 | 1.29 |

All three of the compositions set forth in Table III were found to be non-detonable after being stored for less than one week at about 70° F. The detonation tests were performed with a 2 × 10 inches Power Primer booster supplied by Atlas Powder Company and a No. 6 blasting cap.

EXAMPLE 3

This example is presented for the purpose of demonstrating that noncap sensitive and even non-primer sensitive explosive emulsion sensitizers can be employed in the explosive composition of the subject invention to sensitize aqueous gel explosive compositions. Accordingly, a second emulsion sensitizer was produced in accordance with the procedures set forth in Example 1 above except that no microballoons were added to the emulsion sensitizer. The resulting emulsion (set forth in Table IV as "Emulsion II") is identical to Emulsion I in all other respects but, because of the absence of microballoons, is not capable of being detonated with a No. 6 blasting cap and a 2½ × 8 inches Power Primer. An explosive gel composition sensitized with Emulsion II was then prepared in the manner set forth in the above examples and having the composition set forth in Table IV below.

TABLE IV

| Ingredient | Weight Percent |
|---|---|
| Ammonium Nitrate | 41.1 |
| Sodium Nitrate | 4.5 |
| Sodium Perchlorate | 4.5 |
| Water | 18.8 |
| Ethylene Glycol | 8.9 |
| Emulsion II | 17.90 |
| B28/750 (Glass Microballoons) | 1.3 |
| Guar | 0.65 |
| Potassium Pyroantimonate | 0.0075 |
| Percol 155 | 0.1 |

The gel portion of the composition set forth in Table IV (that is containing all the ingredients except for Emulsion II) was found to be nondetonable with a 2 × 10 inches Power Primer and a No. 6 blasting cap. However, the explosive gel composition set forth in Table IV, containing the non-primer sensitive Emulsion II, was found to be detonable after approximately one week of storage at about 70° F, with a 2 × 10 inches Power Primer supplied by Atlas Powder Company, and a No. 6 blasting cap.

The above examples illustrate that either cap sensitive or noncap sensitive and even non-primer sensitive explosive emulsions of the water-in-oil type can be employed as sensitizers for aqueous gel explosive compositions. Thus cap sensitive, noncap sensitive and non-primer sensitive emulsion sensitizers can be combined with primer sensitive or non-primer sensitive gel portions to form primer sensitive emulsion sensitized aqueous gel explosive compositions. The advantages of using such emulsion sensitizers include greater safety in raw material handling because of possible elimination of premanufactured high explosive materials, more economical explosive compositions, greater power output resulting from incorporation of larger amounts of inorganic oxidizers, good stability and the possibility of employing an emulsion sensitizer which can have either positive or negative oxygen balance values thereby serving as either a fuel or an oxidizer.

While this invention has been described in relation to its preferred embodiments, it is to be understood that various modifications thereof will be apparent to those of ordinary skill in the art upon reading the specification and it is intended to cover all such modifications as fall within the scope of the appended claims.

I claim:

1. An aqueous gel explosive composition comprising up to about 90 percent by weight inorganic oxidizing agents, from about 5 to about 25 percent by weight water, from about 0.2 to about 2.0 percent by weight aqueous gelling agents, from 0.2 to about 10% by weight bulking agents, in the gel portion, and from about 1 to about 80 percent by weight of an explosive emulsion comprising a continuous carbonaceous fuel phase and a discontinuous aqueous phase, said emulsion uniformly distributed in said gel portion.

2. The gel explosive composition of claim 1 wherein said inorganic oxidizing agents are selected from the group consisting of nitrate and perchlorate salts of ammonium, alkali, or alkaline earth or Group III elements nitric acid, and mixtures thereof.

3. the gel explosive composition of claim 2 wherein said inorganic oxidizing agents are selected from the group consisting of ammonium nitrate, sodium nitrate, sodium perchlorate, and mixtures thereof.

4. The explosive gel composition of claim 3 wherein said inorganic oxidizing agents are comprised of from about 10 to about 90 percent by weight of the gel explosive composition of an inorganic nitrate, and from 0 to about 30 percent by weight of the gel explosive composition of an inorganic perchlorate.

5. The gel explosive composition of claim 1 wherein said bulking agent is selected from the group consisting of glass microballoons, resin microballoons, perlite, occluded air and mixtures thereof.

6. The explosive gel composition of claim 1 and further comprising up to about 15 percent by weight thereof of a fuel selected from the group consisting of soft coal, graphite, particulate aluminum, sulphur, ferrophosphorous, alcohols, amides, sugars, ethylene glycol and mixtures thereof.

7. The gel explosive composition of claim 6 wherein said fuel is ethylene glycol.

8. The gel explosive composition of claim 1 and further comprising sensitizers, in addition to the water-in-oil explosive emulsion, in an amount up to about 20 percent by weight of the gel explosive composition.

9. The gel explosive composition of claim 8 wherein said additional sensitizers are selected from the group consisting of nitro alkanes, amine nitrates, heavy metal compounds and mixtures thereof.

10. The gel explosive composition of claim 9 wherein said additional sensitizers are selected from the group consisting of nitromethane, methyl amine nitrate, ethylene diamine dinitrate, and mixtures thereof.

11. The gel explosive composition of claim 1 wherein said aqueous gelling agent is selected from the group consisting of guar gum, polyacrylamide, carboxymethyl cellulose, carboxyethyl cellulose, biopolymers, hydroxyethyl guar, hydroxypropyl guar and mixtures thereof.

12. The gel explosive composition of claim 11 and further comprising an effective amount of a crosslinking agent for said aqueous gelling agent.

13. The gel explosive composition of claim 1 wherein said water-in-oil explosive emulsion comprises from about 2 to about 50 percent by weight carbonaceous fuels, from about 0.2 to about 5.0 percent by weight emulsifiers, from about 40 to about 90 percent by weight inorganic oxidizing salts, from 0 to about 40 percent by weight sensitizing agents, and from about 4 to about 20 percent by weight water.

14. The explosive emulsion of claim 13 wherein said inorganic oxidizing salts are selected from the group consisting of ammonium nitrate, sodium nitrate, sodium perchlorate, and mixtures thereof.

15. The explosive emulsion of claim 13 wherein said carbonaceous fuels comprise from about 2 to about 10 percent by weight of the emulsion.

16. The explosive emulsion of claim 13 wherein said carbonaceous fuels are selected from the group consisting of paraffinic, olefinic, napthenic, aromatic, saturated, and unsaturated hydrocarbons and mixtures thereof.

17. The explosive emulsion of claim 16 wherein said carbonaceous fuel comprises a wax selected from the group consisting of petrolatum wax, microcrystalline wax, paraffin wax, ozocerite, montan wax, animal waxes, insect waxes, Chinese wax, and mixtures thereof.

18. The explosive emulsion of claim 13 further comprising up to about 15 percent by weight of said emulsion of a bulking agent selected from the group consisting of glass microballoons, resin microballoons, perlite, occluded air and mixtures thereof.

19. The explosive emulsion of claim 13 and further comprising an auxiliary fuel, in addition to said carbonaceous fuels, in an amount up to about 20 percent by weight of said explosive emulsion.

20. The explosive emulsion of claim 19 wherein said auxiliary fuel is selected from the group consisting of aluminum, aluminum alloys, magnesium, and mixtures thereof.

21. An aqueous gel explosive composition sensitized by a dispersed water-in-oil explosive emulsion composition wherein said aqueous gel explosive composition has the following composition:

| Ingredient | Weight Percent |
|---|---|
| Inorganic Oxidizing Salts | 10–90 |
| Water | 5–25 |
| Aqueous Gelling Agent | 0.2–2.0 |
| Bulking Agent | 0.2–10.0 |
| Explosive Emulsion Sensitizer | 1–80 |

and, wherein said water-in-oil explosive emulsion sensitizer has the following composition:

| Ingredient | Weight Percent |
|---|---|
| Inorganic Oxidizing Salts | 40–90 |
| Water | 4–20 |
| Emulsifiers | 0.2–5.0 |
| Sensitizing Agents | 0–40 |
| Carbonaceous Fuels | 2–50 |
| Bulking Agents | 0–15 |

22. In an aqueous gel explosive composition comprising inorganic oxidizing salts, water and aqueous gelling agents, the improvement comprising incorporating into said aqueous gel explosive an effective amount of a water-in-oil explosive emulsion composition as a sensitizer therefor.

23. The explosive emulsion sensitized aqueous gel explosive of claim 22 wherein said aqueous gel explosive is non-primer sensitive prior to the addition of said water-in-oil explosive emulsion.

24. The explosive emulsion sensitized aqueous gel explosive of claim 23 wherein said water-in-oil explosive emulsion which is employed as a sensitizer is non-primer sensitive.

25. The explosive emulsion sensitized aqueous gel explosive of claim 23 wherein said water-in-oil explosive emulsion which is employed as a sensitizer is non-cap sensitive.

* * * * *

UNITED STATES PATENT AND TRADEMARK OFFICE

CERTIFICATE OF CORRECTION

PATENT NO. : 4,104,092

DATED : August 1, 1978

INVENTOR(S) : John J. Mullay

It is certified that error appears in the above-identified patent and that said Letters Patent are hereby corrected as shown below:

Column 2, line 19, change "if" to --is--.

Column 3, line 42, change "soluble" to --insoluble--.

Column 5 , lines 17 & 18, change "ether, oleate" to --ether, polyoxyalkylene oleate,--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*